US011535966B2

(12) United States Patent
Jung et al.

(10) Patent No.: US 11,535,966 B2
(45) Date of Patent: Dec. 27, 2022

(54) METHOD OF CONTROLLING WASHING MACHINE

(71) Applicant: LG Electronics Inc., Seoul (KR)

(72) Inventors: Hwanjin Jung, Seoul (KR); Myunghun Im, Seoul (KR); Kyungchul Woo, Seoul (KR)

(73) Assignee: LG Electronics Inc., Seoul (KR)

( * ) Notice: Subject to any disclaimer, the term of this patent is extended or adjusted under 35 U.S.C. 154(b) by 254 days.

(21) Appl. No.: 16/431,035

(22) Filed: Jun. 4, 2019

(65) Prior Publication Data

US 2019/0368100 A1 Dec. 5, 2019

(30) Foreign Application Priority Data

Jun. 4, 2018 (KR) ..... 10-2018-0063984

(51) Int. Cl.
*D06F 33/43* (2020.01)
*D06F 33/36* (2020.01)
(Continued)

(52) U.S. Cl.
CPC ..... *D06F 33/36* (2020.02); *D06B 1/08* (2013.01); *D06F 21/02* (2013.01); *D06F 33/43* (2020.02);
(Continued)

(58) Field of Classification Search
CPC . D06B 1/08; D06F 18/00; D06F 33/00; D06F 33/36; D06F 33/38; D06F 33/40;
(Continued)

(56) References Cited

U.S. PATENT DOCUMENTS 5,191,668 A 3/1993 Euler et al.
9,080,274 B2 7/2015 Kim et al.
(Continued)

FOREIGN PATENT DOCUMENTS

CN 1315600 10/2001
CN 103620103 3/2014
(Continued)

OTHER PUBLICATIONS

Extended European Search Report in European Application No. 19178230.9, dated Nov. 6, 2019, 8 pages.
(Continued)

*Primary Examiner* — David G Cormier
(74) *Attorney, Agent, or Firm* — Fish & Richardson P.C.

(57) ABSTRACT

A method of controlling a washing machine includes spraying water into a drum through a direct water nozzle, rotating the drum at a spin-dry rinse speed, draining water from a tub while rotating the drum at the spin-dry rinse speed, supplying water to the tub to increase a water level in the tub, circulating water in the tub to spray circulated water into the drum through a circulation nozzle, rotating the drum at a laundry adherence speed lower than the spin-dry rinse speed, and in a state in which draining water from the tub and spraying the circulated water are stopped and at least a
(Continued)

portion of the drum is disposed below the water level in the tub, accelerating the drum from the laundry adherence speed to a first tub cleaning speed.

22 Claims, 8 Drawing Sheets

(51) Int. Cl.

| | |
|---|---|
| ***D06B 1/08*** | (2006.01) |
| ***D06F 21/02*** | (2006.01) |
| *D06F 37/30* | (2020.01) |
| *D06F 39/08* | (2006.01) |
| *D06F 103/18* | (2020.01) |
| *D06F 105/48* | (2020.01) |

(52) U.S. Cl.
CPC ..... *D06F 37/30* (2013.01); *D06F 39/085* (2013.01); *D06F 2103/18* (2020.02); *D06F 2105/48* (2020.02)

(58) Field of Classification Search
CPC ..... D06F 33/42; D06F 33/43; D06F 33/47; D06F 33/56; D06F 33/58; D06F 33/60; D06F 33/62; D06F 33/69; D06F 33/74; D06F 34/00–34; D06F 35/00; D06F 35/005; D06F 35/006; D06F 35/007; D06F 35/008; D06F 37/42; D06F 39/00; D06F 39/08; D06F 39/083; D06F 39/085; D06F 58/00; D06F 58/02; D06F 58/203; D06F 58/30; D06F 2101/00–20; D06F 2103/00–70; D06F 2105/50–62; D06F 2202/00–12; D06F 2204/00–10; D06F 2210/00; D06F 2212/00–06; D06F 2214/00; D06F 2216/00; D06F 2220/00; D06F 2222/00; D06F 2224/00; D06F 2226/00
See application file for complete search history.

(56) References Cited

U.S. PATENT DOCUMENTS

| | | | | |
|---|---|---|---|---|
| 2006/0168740 | A1 | 8/2006 | Ha et al. | |
| 2007/0084000 | A1* | 4/2007 | Bernardino | D06F 39/02 8/158 |
| 2009/0090388 | A1* | 4/2009 | Kim | D06F 33/00 134/18 |
| 2011/0146002 | A1 | 6/2011 | Kim et al. | |
| 2013/0198969 | A1 | 8/2013 | Kim et al. | |
| 2014/0033449 | A1* | 2/2014 | Im | D06F 39/08 8/137 |
| 2015/0299926 | A1 | 10/2015 | Kim et al. | |
| 2017/0096769 | A1* | 4/2017 | Kim | D06F 33/46 |

FOREIGN PATENT DOCUMENTS

| | | |
|---|---|---|
| CN | 103668860 | 3/2014 |
| EP | 2698462 | 2/2014 |
| JP | 2013052124 | 3/2013 |
| JP | 2017029248 | 2/2017 |
| JP | 2017064427 | 4/2017 |
| KR | 20160044901 | 4/2016 |
| KR | 101617290 | 5/2016 |
| WO | WO2017135602 | 8/2017 |

OTHER PUBLICATIONS

PCT International Search Report in International Application No. PCT/KR2019/006733, dated Sep. 30, 2019, 3 pages.
Chinese Office Action in CN Appln. No. 201910480652.2, dated Jan. 6, 2021, 7 pages (with English translation).
Office Action in Chinese Appln. No. 201910480652.2, dated Jul. 12, 2021, 16 pages (with English translation).
Office Action in Korean Appln. No. 10-2018-0063984, dated Aug. 22, 2022, 13 pages (with English translation).

* cited by examiner

METHOD OF CONTROLLING WASHING MACHINE

CROSS-REFERENCE TO RELATED APPLICATION

This application claims the priority benefit of Korean Patent Application No. 10-2018-0063984, filed on Jun. 4, 2018, the disclosure of which is incorporated herein by reference.

BACKGROUND OF THE INVENTION

1. Field of the Invention

The present invention relates to a washing machine including a circulation nozzle, and a method of controlling the same.

2. Description of the Related Art

A washing machine is an apparatus that receives laundry in a drum installed in a tub with water contained therein and rotates the drum to wash the laundry.

A washing machine having a nozzle for spraying water supplied from an exterior water source into drum and using the nozzle for a rinse cycle or a spin dry cycle is a well known type of washing machine. As an example of such an washing machine, Korean Patent Application Publication No. 10-2014-0037084 (hereinafter, referred to as Related Art) discloses a washing machine including a circulation nozzle for spraying circulating water and a direct water nozzle for directly spraying water supplied from the water source.

The Related Art discloses a rinse cycle of rinsing laundry using the circulation nozzle and the direct water nozzle. In particular, the Related Art discloses a (turbo rinsing) cycle of rinsing laundry by rotating the drum at a speed 1G or more, where the laundry is rotated while being attached to the drum. In addition, in order to reduce foaming of residual detergent, the Related Art suggests that the amount of the water is preferably set to a degree where the water can be circulated.

In the Related Art, a pump used for circulation is driven at a constant speed, so it is sufficient to supply the amount of water as much as being able to be circulated without leaving the pump idling. However, in the case where a variable speed pump is applied to spray circulating water with high pressure, it is necessary to supply sufficient water to prevent idling of the pump, and thus providing insufficient water as disclosed in the Related Art is considered inappropriate.

SUMMARY OF THE INVENTION

A first object of the present invention is to provide a method of controlling a washing machine, the method which is capable of performing tub cleaning for hygiene purposes in a series of procedures performed to rinse laundry.

A second object of the present invention is to provide a method of controlling a washing machine, the method which uses a less amount of water and improves rinse performance.

A third object of the present invention is to provide a method of controlling a washing machine, the method which is capable of performing tub cleaning with water used in rinsing laundry.

A fourth object of the present invention is to provide a method of controlling a washing machine, the method which keeps an amount of water sufficient even when circulating water is sprayed by increasing a pump rate.

A fifth object of the present invention is to provide a method of controlling a washing machine, the method which is able to reduce foaming in a rinse cycle.

A sixth object of the present invention is to provide a method of controlling a washing machine, the method which sprays the water through a direct water nozzle and circulation nozzles at the same time, thereby enabling three-dimensional spraying of water and thus wetting laundry uniformly.

The method of controlling a washing machine according to the present invention includes spin-dry rinse, rotational water supply, and hygiene cleaning.

The spin-dry rinse is a step of, while water is sprayed into the drum through a direct water nozzle, rotating the drum at a spin-dry rinse speed, where the laundry in the drum is able to rotate along with the drum while adhered to and not falling from the drum even when the laundry is lifted to a highest point inside the drum, and draining water from the tub while the drum is rotated at the spin-dry rinse speed.

The rotational water supply is a step of increasing a water level of the tub by providing a water supply to the tub, and circulating the water in the tub to be sprayed into the drum through a circulation nozzle, wherein, while the water is sprayed through the circulation nozzle, the drum is rotated at a laundry adherence speed that is set to be lower than the spin-dry rinse speed within a range where the laundry is able to rotate along with the drum without falling from the highest point inside the drum.

The hygiene cleaning is a step of, while the draining of the tub and the spraying of the water through the circulation nozzle are stopped and at least a portion of the drum is submerged in water contained in the tub, accelerating the drum from the laundry adherence speed to a first tub cleaning speed.

The spin-dry rinse may further include a step of accelerating the drum from a stopped state to the spin-dry rinse speed.

The rotational water supply may include a step of decelerating the drum from the spin-dry rinse speed to the laundry adherence speed.

The water supply to the tub in the rotational water supply may be provided through a dispenser.

The hygiene cleaning may further include a step of decelerating the drum from the first tub cleaning speed to a second tub cleaning speed, and, in this case, the second tub cleaning speed may be higher than the laundry adherence speed. The hygiene cleaning may further include a step of spraying water into the drum through the direct water nozzle while draining the tub, and decelerating the drum from the second tub cleaning speed to a laundry adherence maintaining speed.

The method of controlling a washing machine according to the present invention may further include: a wash step (or a wash cycle) of adding detergent to the laundry in the drum by rotating the drum in which detergent-dissolved water is contained; and a rinse step (or a rinse cycle) of removing the detergent from the laundry in the drum by draining water used in the wash step and supplying water into the drum, and the above-described steps may be performed during the rinse step.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Figure 1:
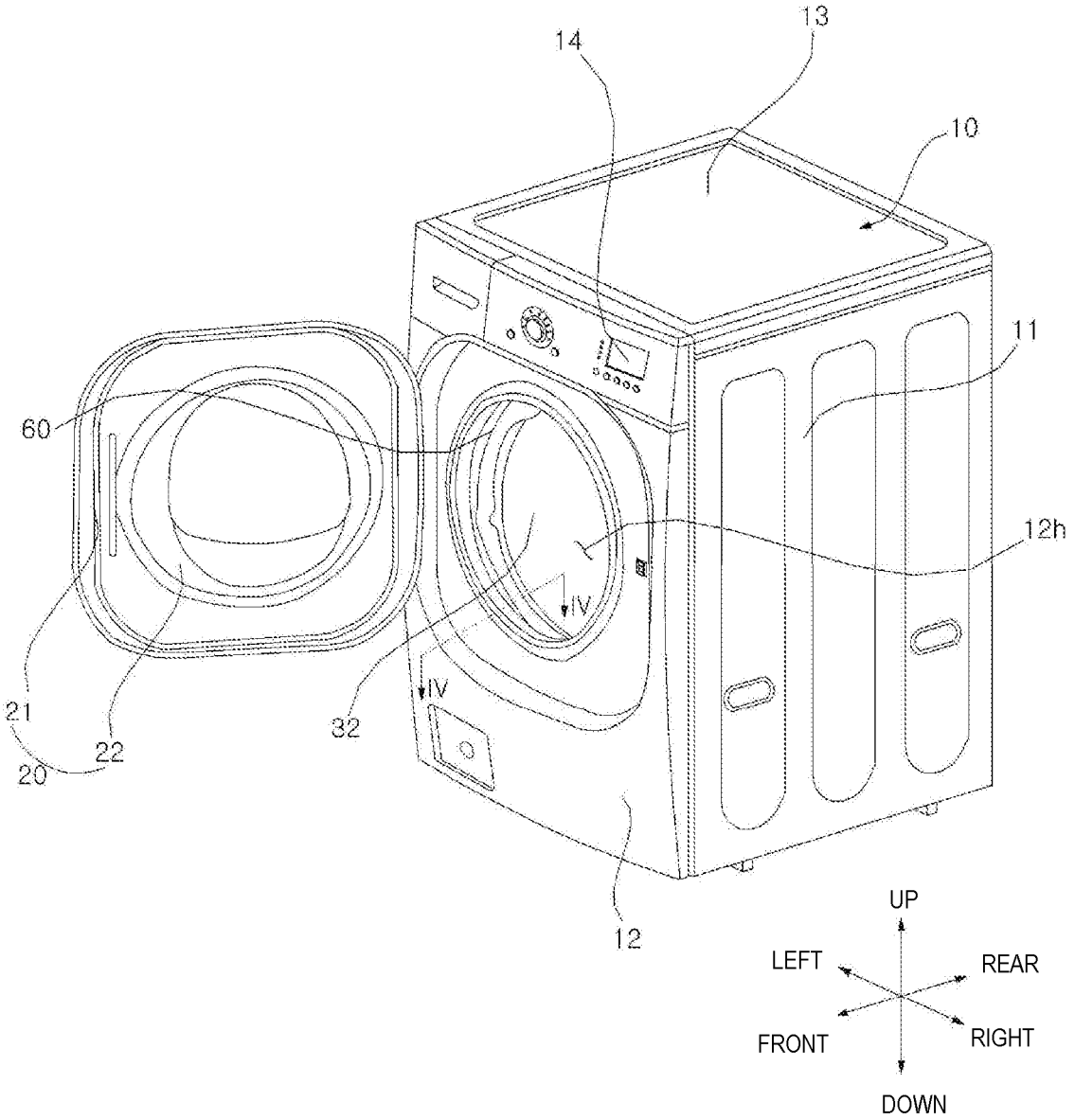
FIG. 1 is a perspective view of a washing machine according to an embodiment of the present invention.

Advantages and features of the present invention and methods for achieving them will be made clear from the embodiments described below in detail with reference to the accompanying drawings. The present invention may, however, be embodied in many different forms and should not be construed as being limited to the embodiments set forth herein. Rather, these embodiments are provided so that this disclosure will be thorough and complete, and will fully convey the scope of the invention to those skilled in the art. The present invention is defined only by the scope of the claims. Like reference numerals refer to like elements throughout the specification.

Figure 2:
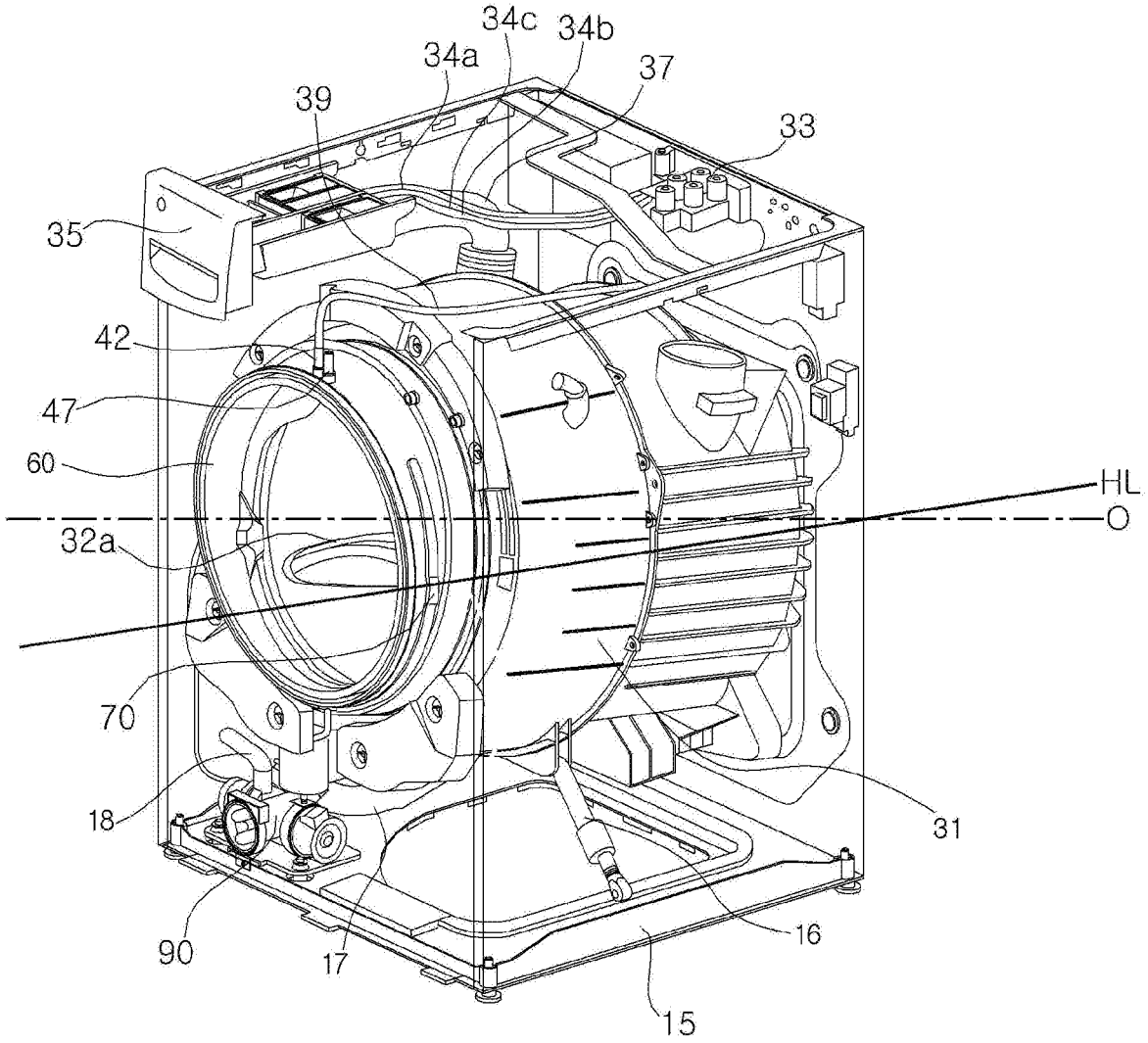
FIG. 2 illustrates part of the washing machine shown in FIG. 1.
Figure 3:
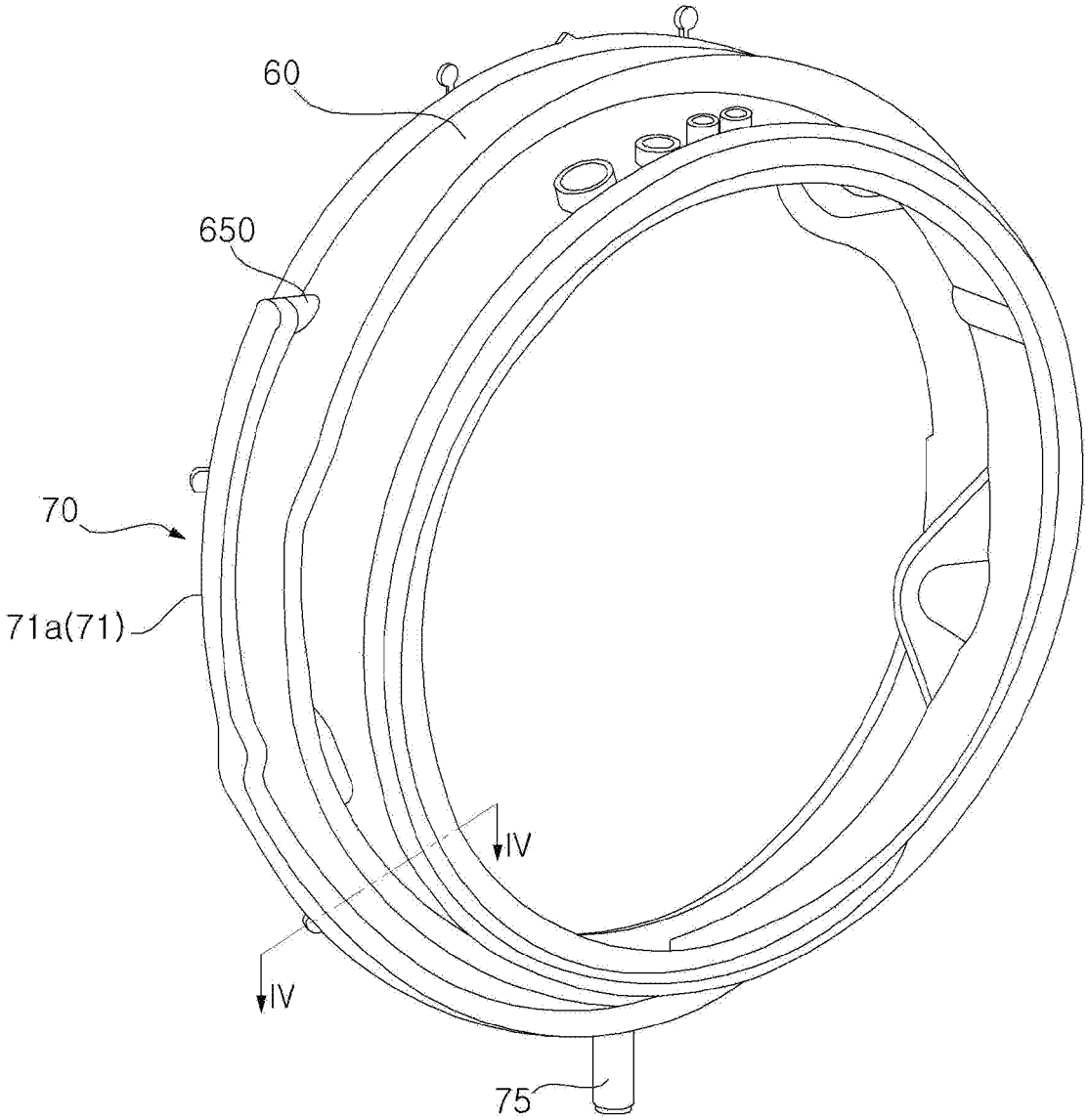
FIG. 3 illustrates the assembly of a gasket and a conduit.
Figure 4:
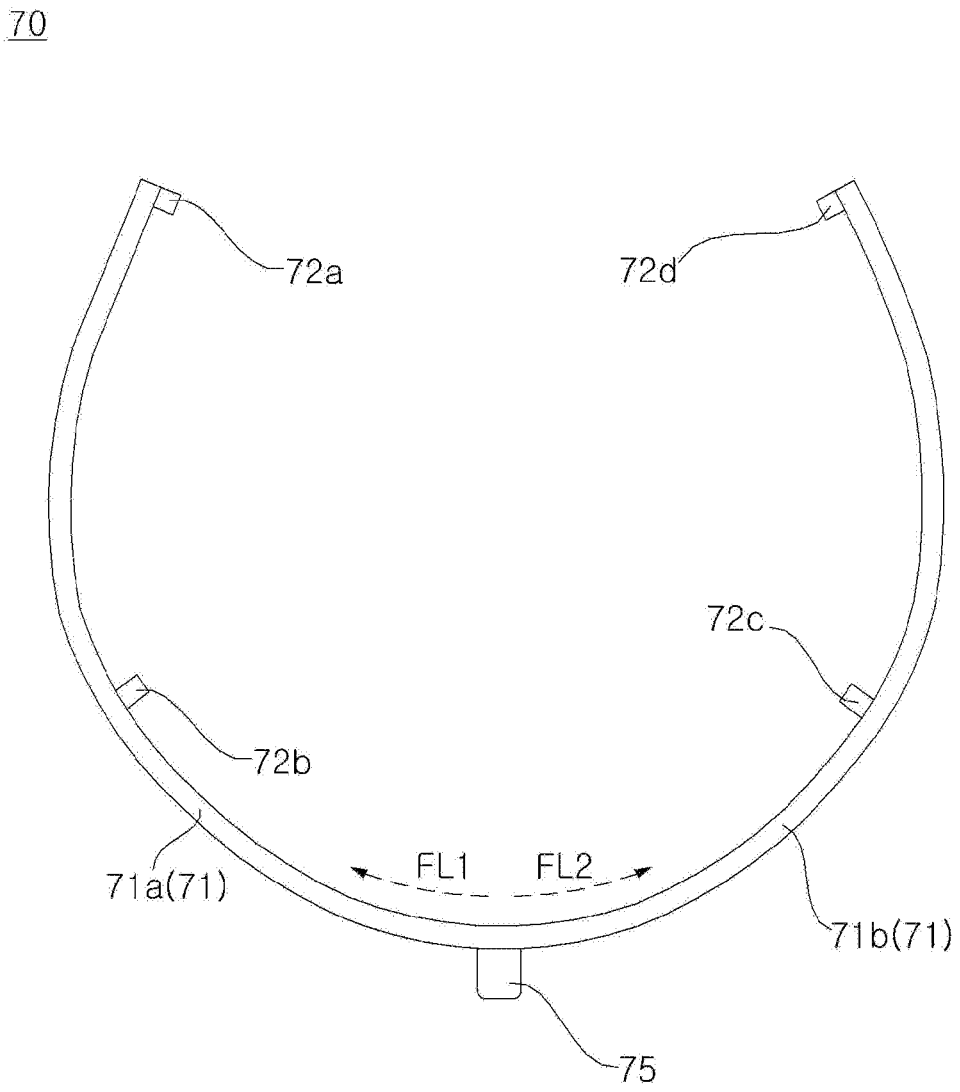
FIG. 4 is a cross-sectional view taken along line IV-IV shown in FIG. 1.
Figure 5:
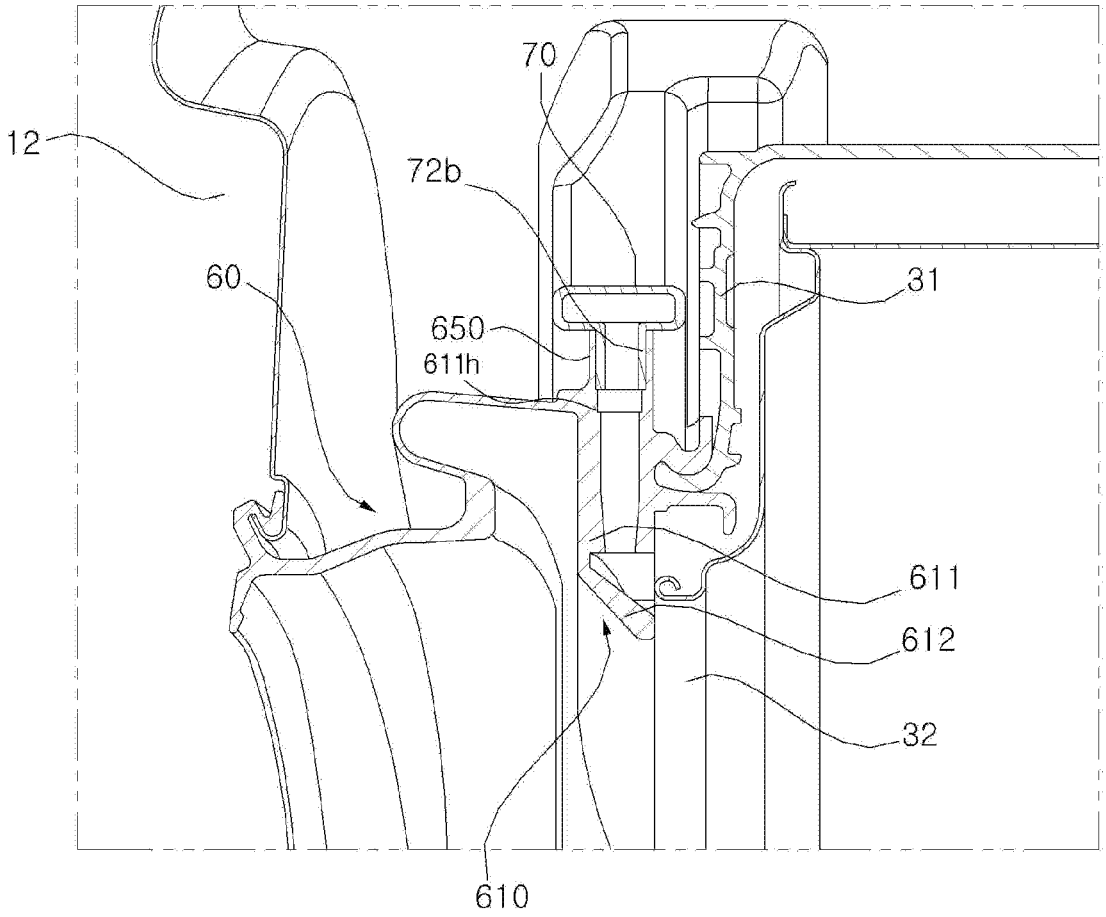
FIG. 5 illustrates a conduit.
Figure 6:
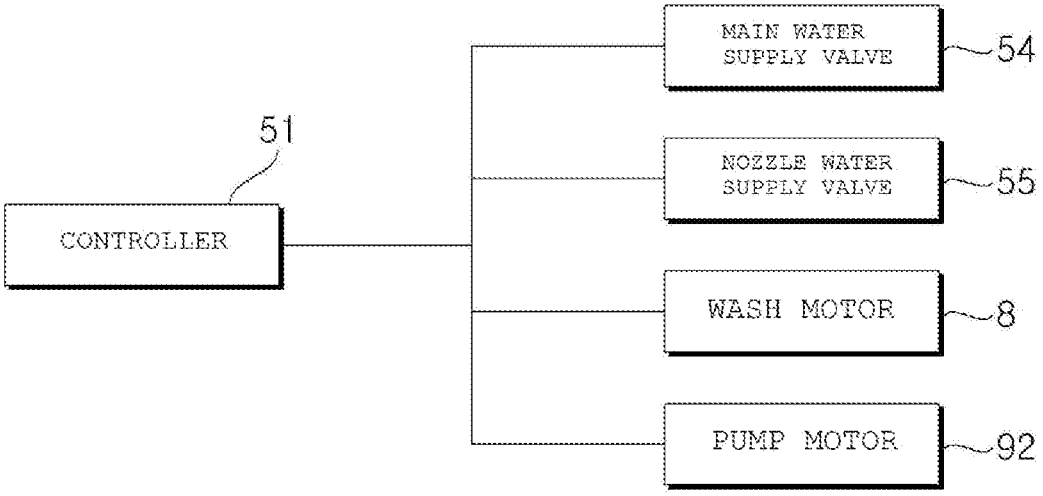
FIG. 6 is a block diagram illustrating a control relationship between major components of a washing machine according to an embodiment of the present invention.

FIG. 1 is a perspective view of a washing machine according to an embodiment of the present invention. FIG. 2 illustrates part of the washing machine shown in FIG. 1. FIG. 3 illustrates the assembly of a gasket and a conduit. FIG. 4 is a cross-sectional view taken along line IV-IV shown in FIG. 1. FIG. 5 illustrates a conduit. FIG. 6 is a block diagram illustrating a control relationship between major components of a washing machine according to an embodiment of the present invention.

Referring to FIGS. 1 to 6, a casing 10 forms an exterior appearance of a washing machine, and an introduction hole 12*h* through which laundry can be introduced is formed on a front of the casing 10. The casing 10 may include a cabinet 11 having an open front surface, a left surface, a right surface, and a rear surface, and a front panel 12 coupled to the open front surface of the cabinet 11 and having the introduction hole 12*h* formed therein.

The bottom and top of the cabinet 11 are open, and a horizontal base 15 supporting the washing machine may be coupled to the bottom of the cabinet 11. In addition, the casing 10 may further include a top plate 13 covering the open top of the cabinet 11, and a control panel 14 over the front panel 12.

A tub 31 for containing water may be disposed in the casing 10. The tub 31 may have an entrance opening formed at the front so that laundry can be introduced into the tub 31. The cabinet 11 and the tub 31 are connected by the annular gasket 60 and thereby a passage for introduction and exit of laundry may be formed in a section from the entrance of the tub 31 to the entry hole 12*h*.

The door 20 for opening and closing the introduction hole 12*h* may be rotatably coupled to the casing 10. The door 20 may include: a door frame 21 being open approximately at a central portion thereof and rotatably coupled to the front panel 12; and a window 22 installed at the open central portion of the door frame 21. The window 22 may be in a shape convex rearward, at least a portion of which is positioned in an area surrounded by an inner circumferential surface of the gasket 60.

A front end and a rear end of the basket 60 are annular, and the gasket 60 is in a tubular shape extending from the front end to the rear end. The front end of the gasket 60 is fixed to the casing 10, and the rear end of the gasket 60 is fixed to the circumference of the entrance opening of the tub 31. The gasket 60 may be formed of a flexible or elastic material. The gasket 60 may be formed of rubber or synthetic resin. When the door 20 is closed, the front end of the gasket 60 is brought into contact with a rear surface of the door 20, thereby preventing that water leaks from the tub 31 through the entrance of the gasket 60.

Hereinafter, a portion defining the inside of the tubular shape of the gasket 60 is referred to as an inner circumferential part (or an inner circumferential surface) of the gasket 60, and a portion opposite thereto is referred to as an outer circumferential part (or an outer circumferential surface) of the gasket 60.

The drum 32 may be rotatably provided in the tub 31. The drum 32 is to receive laundry and disposed to with the entrance opening thereof positioned at the front, the entrance opening through which laundry is to be introduced, and the drum 32 rotates about an approximately horizontal axis O. In this case, "horizontal" does not refer to the mathematical definition thereof. That is, even in the case where the axis O is inclined at a predetermined angle relative to a horizontal state HL, the axis may be considered substantially horizontal if the axis is more like in the horizontal state than in a vertical state. To allow water to flow from the tub 31 into the drum 32, a plurality of through-holes 3 (not shown) may be formed in the drum 32.

A plurality of lifter 32*a* may be provided on an inner surface of the drum 32. The plurality of liters 32*a* may be disposed at a predetermined angle relative to the center of the drum 32. When the drum 32 is rotated, laundry repeatedly goes through an operation of being lifted by the lifter 32*a* and falling.

A driving unit for rotating the drum 32 is further provided. A driving shaft (not shown) to be rotated by the driving unit may penetrate the rear of the tub 31 to be coupled to the drum 32.

Preferably, the driving unit includes a direct drive wash motor, and the wash motor may include a stator fixed to the rear of the tub 31, and a rotor rotating by a magnetic force acting in relation with the stator. The driving shaft may rotate integrally with the rotor.

The tub 31 may be supported by a damper 16 installed at the base 15. Vibration of the tub 31 caused by rotation of the drum 32 is attenuated by the damper 16. In some embodiments, although not illustrated, a hanger (e.g., a spring) for hanging the tub 31 to the casing 10 may be further provided.

There may be provided at least one water supply horse (not shown) for guiding water introduced from an external water source such as a water tap or the like, and a water supply unit 33 for controlling the water supplied through the at least one water supply horse to flow to at least one tube 34*a*, 34*b*, or 34*c* which will be described later.

A dispenser 35 for supplying additives such as detergent for washing, fabric softener, and the like into the tub 31 or the drum 32 may be provided. The additives are contained in the dispenser 35 separately by types thereof. The dispenser 35 may include a detergent container (not shown) for containing detergent for washing, and a fabric softer container (not shown) for containing a fabric softener.

At least one water supply tube 34*a*, 34*b*, or 34*c* for selectively guiding water supplied from the water supply unit 33 to each container of the dispenser 35 may be provided. The water supply unit 33 may include at least one water supply valve for regulating each of the at least one water supply tube 34*a*, 34*b*, or 34*c*.

The at least one water supply tube 34*a*, 34*b*, or 34*c* may include a first water supply tube 34*a* for supplying cold water supplied through a cold water supply horse to the detergent container, a second water supply tube 34*b* for supplying water supplied through the cold water supply horse to the fabric softer container; and a third water supply tube 34*c* for supplying hot water supplied through a hot water supply horse to the detergent container.

The main water supply valve 54 may be provided in plural. For example, the main water supply valve 54 may include a first main water supply valve for regulating the first water supply pipe 34*a*, a second main water supply valve for regulating the second water supply pipe 34*b*, and a third main water supply valve for regulating the third water supply pipe 34*c*. These main water supply valves may be controlled by the controller 51.

The gasket 60 may include a direct water nozzle 42 for spraying water into the drum 32, and a direct water supply tube 39 for guiding water supplied from the water supply unit 33 to the direct water nozzle 42. The direct water nozzle 42 may be a whirl nozzle or a spray nozzle, but aspects of the present invention are not necessarily limited thereto.

Water discharged from the dispenser 35 may be supplied to the tub 31 through a water supply bellows 37. A water supply hole (not shown) connected to the water supply bellows 37 may be formed on a side surface of the tub 31.

A drain hole for draining water may be formed in the tub 31, and a drain bellows 17 may be connected to the drain hole. A pump 90 for pumping water discharged from the tub 31 through the drain bellows 17 may be provided. A drain valve (not shown) for regulating the drain bellows 17 may be further provided. The water drained through the drain bellows 17 may be drained to the outside of the washing machine through a drain pipe (not shown).

The pump 90 may selectively perform a draining function of pumping water drained through the drain bellows 17 to the drain pipe, and a circulation function of pumping water to a circulation tube 18. There are already various well-known technologies for selectively implementing the draining function and the circulating function with one pump, and thus, a detailed description thereof is herein omitted.

However, aspects of the present invention are not limited thereto, and there may be provided a circulation pump connected to the circulation tube 18 to circulate water and a drain pump connected to the drain pipe to drain water.

Hereinafter, circulating water pumped by the pump 90 to be guided along the circulation tube 18 may be referred to as circulating water.

A flow rate (or water discharge pressure) of the pump 90 is variable. To do so, a pump motor rotating an impeller may be a variable speed motor of which speed of rotation can be controlled. The pump motor may be appropriately a Brushless Direct Current Motor (BLDC) motor, but aspects of the present invention are not necessarily limited thereto. A driver for controlling speed of the pump motor may be further provided, and the driver may be an inverter driver. The inverter driver may convert AC power into DC power and input the converted power to the motor at a target frequency.

A controller (not shown) for controlling the above-described pump motors may be further provided. The controller may include a Proportional-Integral (PI) controller, a Proportional-Integral-Derivative (PID) controller), and the like. The controller may receives an output value (e.g., an output current) of a pump motor, and control an output value of the driver based on the received output value of the pump motor so that the number of times of rotation of the pump motor follows a preset target number of times of rotation.

The gasket 60 includes at least one circulation nozzle 610 for spraying water (circulating water) into the drum 32. Water discharged from the pump 90 is supplied to the circulation nozzle 610 through a circulation pipe 18.

The circulation nozzle 610 may be disposed on the gasket 60. Hereinafter, an example of the circulation nozzle 610 integrally formed with the gasket 60 will be described, but aspects of the present invention are not necessarily limited thereto. The circulation nozzle 610 may be configured separately from the gasket 60 to be coupled to the gasket 60.

A plurality of circulation nozzles 610 may be formed on an inner circumferential part of the gasket 60. When the gasket 60 is viewed from front, the plurality of circulation nozzles 610 may be disposed such that two nozzles are respectively and symmetrically positioned on the left side and on the right side of the gasket 60.

A first circulation nozzle 610 (a circulation nozzle connected to a nozzle water supply port 72*b* which will be described later) at a lower position out of two circulation nozzles 610 on one side of the gasket 60, sprays circulating water upward, whist a second circulation nozzle 610 (a circulation nozzle connected to a nozzle water supply port 72*a* which will be described later) at an upper position out of two circulation nozzles 610 on one side of the gasket 60 sprays circulating water downward.

A conduit 70, which guides circulating water pumped by the pump 90 to the plurality of circulation nozzles 610, is fixed to the gasket 60. A circulation pipe 18 for guiding water discharged from the pump 90 may be connected to an inlet port 75 of the conduit 70.

The conduit 70 includes: a transport pipe 71 for dividing water introduced through the inlet port 75 in both directions to guide; and a plurality of nozzle water supply ports 72*a*, 72*b*, 72*c*, and 72*d* distributing the water guided along the transport pipe 71 to the plurality of circulation nozzles 610. The transfer conduit 71 may be in a shape corresponding to an exterior appearance of the gasket and thereby guide circulating water in an approximate circumferential direction (or a direction that extends along the annular shape formed by an outer circumference of the gasket 60).

The transport pipe 71 forms a channel along which circulating water flows, and the transport pipe 71 is connected to the exit of the inlet port 75. The transport pipe 71 may include: a first pipe part 71*a* for guiding a first subflow F11 of circulating water, introduced through the inlet port 75, in a first direction; and a second pipe part 71*b* for guiding a second subflow FL2 of the circulating water, introduced through the inlet port 75, in a second direction. The first pipe part 71*a* and the second pipe part 71*b* may be symmetric to each other. In each of the first pipe part 71*a* and the second pipe part 71*b*, one end through which circulating water is introduced through the inlet port 75 is open and the other end is blocked.

The conduit 70 includes a plurality of nozzle water supply ports 72*a*, 72*b*, 72*c*, and 72*d* protruding from the transport pipe 71. The plurality of nozzle water supply ports 72*a*, 72*b*, 72*c*, and 72*d* is formed at positions respectively corresponding to the plurality of circulation nozzles 610. In the present embodiment, as shown in FIG. 5, the plurality of nozzle water supply ports 72*a*, 72*b*, 72*c*, and 72*d* are disposed such that two nozzles are respectively positioned on the left side and on the right side of the inlet port 75. However, aspects of the present invention are not limited thereto, and the number of the circulation nozzles 610 and the number of nozzle water supply ports 72*a*, 72*b*, 72*c*, and 72*d* corresponding thereto may vary.

Meanwhile, each of the nozzles 610 may include a nozzle inlet pipe 611 protruding inwardly from the inner circumferential part of the gasket 60 in a radial direction, and a nozzle head 612 connected to the nozzle inlet pipe 611. The nozzle inlet pipe 611 has one end connected to the inner circumferential part of the gasket 60 and communicating with a port insertion pipe 650, and the other end connected to a corresponding nozzle head 613.

The gasket 60 may include a plurality of port insertion pipes 650 protruding from the outer circumferential part of the gasket 60 at positions respectively corresponding to the nozzle inlet pipes 611. Each of the port insertion pipes 650 communicates with a corresponding nozzle inlet pipe 611, and each of the nozzle water supply ports 72*a*, 72*b*, 72*c*, and 72*d* is inserted into a corresponding port insertion pipe 650. Circulating water discharged from the nozzle water supply ports 72*a*, 72*b*, 72*c*, and 72*d* is supplied to the nozzle heads 612 through the nozzle inlet pipes 611.

In the transport pipe 71, at least one first nozzle water supply port 71*a* or 72*b* is formed on the first pipe part 71*a* through which the first subflow FL1 is guided. The first nozzle water supply ports 72*a* and 72*b* respectively discharge circulating water to the circulation nozzles 610 (circulation nozzles positioned on the left side when the gasket 60 is viewed from the front in the present embodiment).

The first pipe part 71*a* guides circulating water in a first direction (a clockwise direction when viewed from the front in the present embodiment) from the exit of the inlet port 75 in a channel formed by the transport pipe 71.

Similarly, in the transport pipe 71, at least one nozzle water supply port 72*c* or 72*d* through which the second subflow FL2 is guided is formed on the second pipe part 71*b*. The second nozzle water supply ports 72*c* and 72*d* respectively discharge circulating water to the second circulation nozzles 610 (circulation nozzles positioned on the right side when the gasket 60 is viewed from the front in the present embodiment).

The second pipe part 71*b* guides circulating water in a second direction (a counter-clockwise direction when viewed from the front in the present invention) from the exit of the inlet port 75 in the passage formed by the transport pipe 71.

The transport pipe 71 is disposed in the outer circumferential part of the gasket 60, and the plurality of nozzle water supply ports 72*a*, 72*b*, 72*c*, and 72*d* may pass through the gasket 60 from the outer circumferential part to the inner circumferential part and thereby be connected to the plurality of circulation nozzles 610, respectively.

Figure 7:
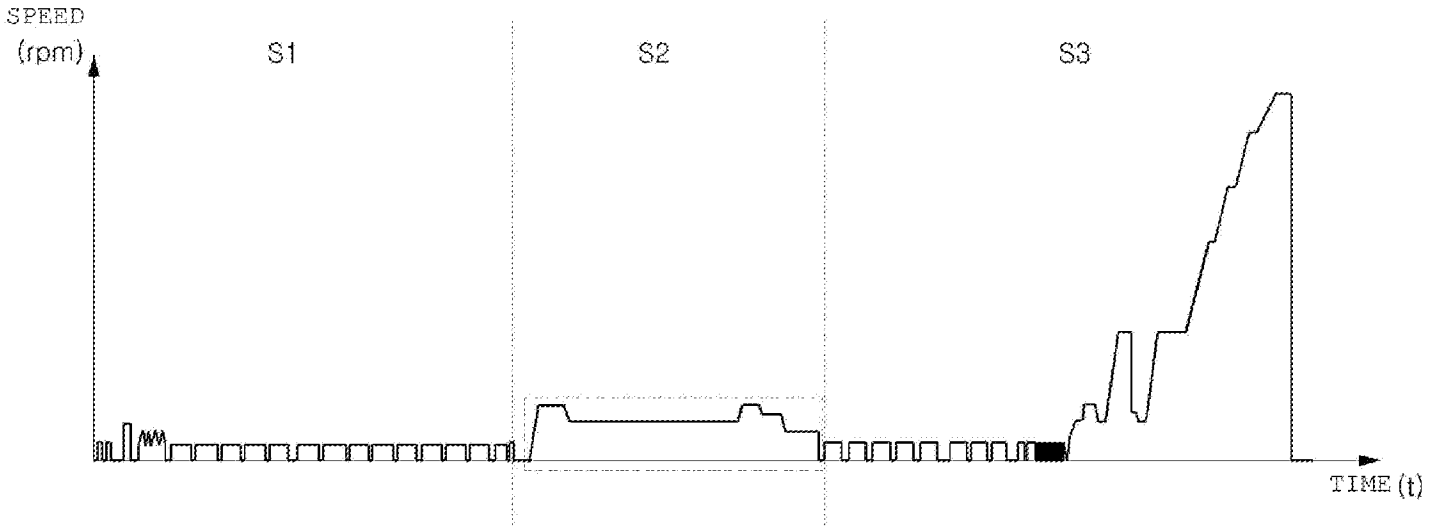
FIG. 7 is a graph illustrating variation in speed of a washing motor according to a method of controlling a washing machine according to an embodiment of the present invention.
Figure 8:
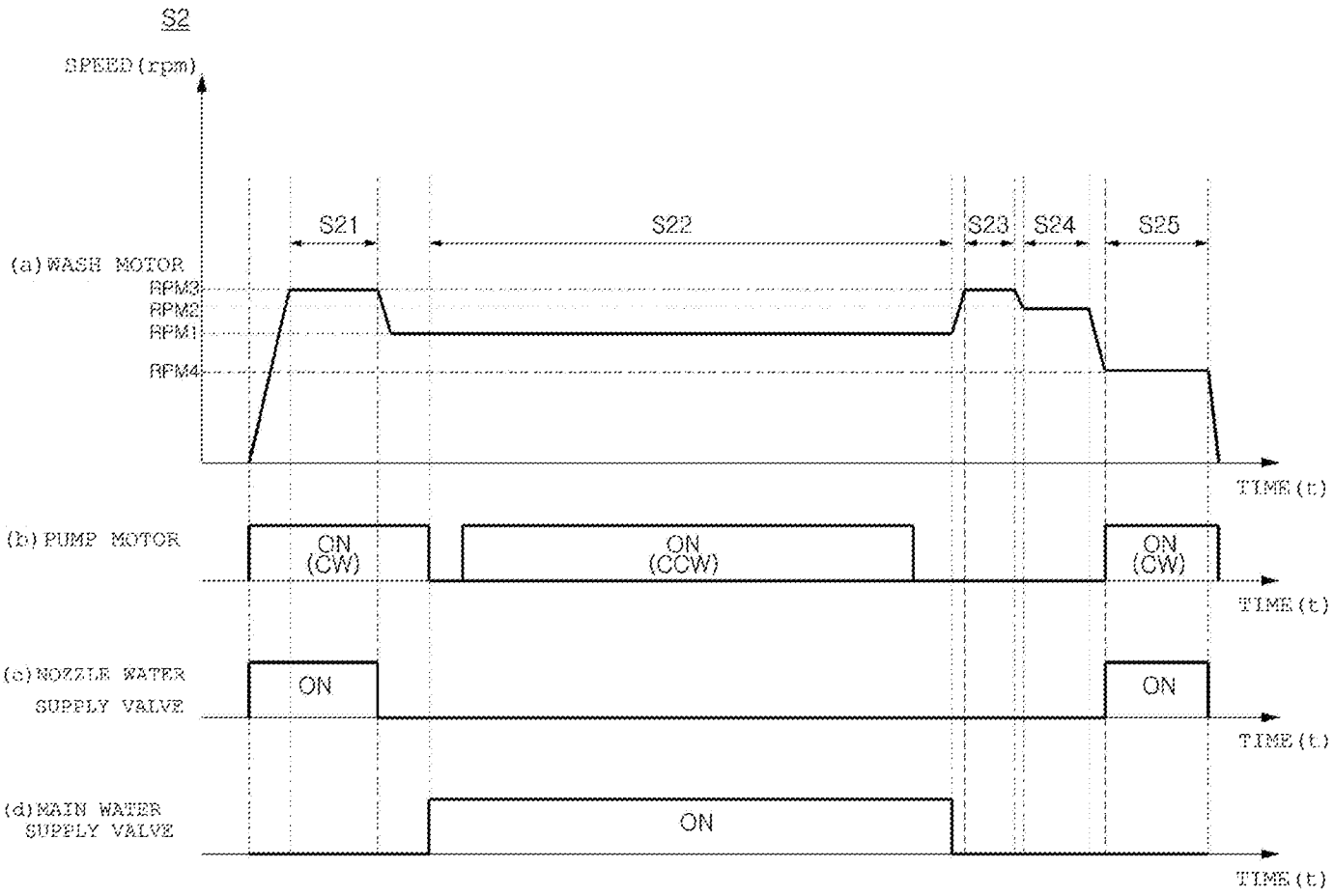
FIG. 8 is a graph illustrating (a) an enlarged view of a portion marked with a dotted line in FIG. 7, (b) an operation of the pump motor, (c) operation of a nozzle water supply valve, and (d) an operation of a main water supply valve.

FIG. 7 is a graph illustrating variation in speed of a washing motor according to a method of controlling a washing machine according to an embodiment of the present invention. FIG. 8 is a graph illustrating (a) an enlarged view of a portion marked with a dotted line in FIG. 7, (b) an operation of the pump motor, (c) operation of a nozzle water supply valve, and (d) an operation of a main water supply valve. Hereinafter, the method of controlling a washing machine according to an embodiment of the present invention will be described with reference to FIGS. 7 and 8.

The washing machine may sequentially implement a wash cycle (or a wash step (S1)), a rinse cycle (or a rinse step (S2)), a spin dry cycle (or a spin dry step (S3)). The wash cycle S1 is a step of adding detergent to laundry by rotating the drum 32 while detergent-dissolved water (hereinafter, referred to as "wash water") is contained in a drum 32. In the wash cycle S1, water supply is provided through a dispenser 35, and detergent is supplied together with the water in this course. In the wash cycle S1, the rotation of the drum may be performed in any of various patterns. For example, there may be a tumbling pattern in which the drum 32 is continuously rotated at least once or more at a constant speed so that laundry in the drum 32 is lifted to a predetermined level and falls therefrom, and a rolling pattern in which the drum 32 is rotated at a speed lower than the speed of the tumbling pattern so that the laundry is lifted to a predetermined height and rolls down along with the drum 32. However, aspects of the present invention are not limited thereto, and any other pattern may be implemented.

The rinse cycle (S2) is a step of removing detergent added to the laundry in the wash cycle (S1). In the rinse cycle (S2), water used in the wash cycle S1 is drained and water is supplied into the drum 32 again. The rinse cycle S2 will be described in more details.

The spin dry cycle S3 is a step of removing water from laundry by performing a drainage while rotating the drum 32 at a high speed after the rinse cycle S2. As the spin dry cycle S3 is implemented after the laundry are all rinsed, water supply is generally not necessary in this cycle yet, if repositioning of the laundry is required for balancing, water can be added. In the spin dry cycle S3, the drum 32 is rotated at a speed higher than the speed in the rinse cycle S2, and thus, several resonance points are to be past in the acceleration of the drum 32. Accordingly, the washing machine needs to be configured to increase a rotational speed of the drum 32 in multiple phases in a manner of rotating the drum 32 at a constant speed, checking eccentricity of the drum 32 before the rotational speed of the drum 32 reaches a resonance point, and, in response to the eccentricity being equal to or smaller than an allowable threshold value, accelerating the drum 32 to pass the resonance point fast.

Hereinafter, an example in which spin-dry rinse phase S21, a rotational water supply phase S22, and a hygiene cleaning phase S23 and S24 form the rinse cycle S2 will be described. However, in some embodiments, the spin dry phase S21, the rotational water supply phase S22, and the hygiene cleaning phase S23 and S24 may compose the wash cycle S1 or the spin dry cycle S3.

The spin-dry rinse S21 includes a step of spraying water into the drum 32 through the direct water nozzle 42, where the drum 32 is rotated at a spin-dry rinse speed RPM3 to drain the tub 31. Aa the nozzle water supply valve 55 is opened by the controller 51, water is sprayed through the direct water nozzle 42 and a drainage process is performed at the same time.

In the present embodiment, the drainage process is performed by the pump 90. In particular, the pump 90 includes a pump motor 92 capable of rotating an impeller bidirectionally. When the pump motor 92 rotates in a forward direction CW, water is drained out, and, when the pump motor 92 rotates in a backward direction CCW, water is circulated. However, in some embodiments where a drain pump is provided in addition to a circulation pump, water may be drained by the drain pump. Furthermore, there may be some cases where an additional pump for drainage is not provided. In such cases, when a drain valve for regulating a drain channel is opened, water is drained naturally by a differential head.

At the spin-dry rinse speed RPM3, even though water is sprayed into the drum 32 through the direct water nozzle 42, laundry remains stuck to the drum 32 while the drum 32 is rotated. That is, while the drum 32 is rotated at the spin-dry rinse speed RPM3, the laundry rotates along with the drum 32 without falling even when the laundry is lifted to the highest point in the drum 32.

A centrifugal force mrω^2 acting on laundry during rotation of the drum 32 is decided by a mass m of the laundry, a distance r from the center of the drum 32 to the laundry, and a rotational speed ω of the drum 32. A minimum rotational speed (hereinafter, referred to as laundry adherence speed) is calculated when the centrifugal force mrω^2 and the gravity mg are equivalent. In this case, the mass m is removed from both sides of the equation. In conclusion, the laundry adherence speed is a value decided by the distance r from the center of the drum 32 to the laundry and the rotational speed w of the drum.

Here, the distance r varies depending on a position of the laundry in the drum 32, and the laundry adherence speed theoretically differs depending on a condition of the laundry in the drum 32. However, movement of the laundry caused by rotation of the drum 32 has a component in the centrifugal direction. Accordingly, even laundry positioned at the center of the drum 32 becomes spaced a predetermined distance from the center of the drum 32 after the drum 32 is rotated by a certain degree, and thus, if the drum 32 is rotated at a laundry adherence speed corresponding to the predetermined distance for a predetermined time, all laundry items in the drum 32 substantially rotate along with the drum 32 without falling from the highest point in the drum 32. The laundry adherence speed is a value calculated in experiments. In the present embodiment, the laundry adherence speed is 108 RPM and may vary by design of the drum 32.

In the spin-dry rinse S21, the drum 32 is accelerated from a stopped state to a spin-dry rinse speed RPM3 and rotate for a predetermined time with maintaining the spin-dry rinse speed RPM3. While the drum 32 is accelerated, laundry moves to an outer periphery along a radial direction of the drum. In this course, water sprayed through the direct water nozzle 42 gives impact to the laundry, possibly causing resistance to movement of the laundry. In order for the laundry to overcome the resistance and stick to the drum 32, the spin-dry rinse speed RPM3 is preferably set to be higher than the laundry adherence speed. In the present embodiment, the spin-dry rinse speed RPM3 is 150 rpm, but aspects of the present invention are not necessarily limited thereto.

The rotational water supply S22 is implemented after the spin-dry rinse S21. The rotational water supply S22 is a step of raising a water level by supplying water into the tub 31, and, in this course, water in the tub 31 is circulated and sprayed into the drum 32 through the circulation nozzles 610.

The rotational water supply S22 is implemented preferably through the dispenser 35 as the main water supply valve 54 is opened. However, aspects of the present invention are not limited thereto. In some embodiments, the rotational water supply S22 may be implemented through the direct water nozzle 42 or through both the dispenser 35 and the direct water nozzle 42.

In the rotational water supply S22, a water supply is provided while drainage is stopped. As a result, the amount of water in the tub 31 increases. There may be a water level sensor (not shown) for detecting a water level of the tub 31, and the controller 51 may stop supplying water when a water level detected by the water level sensor reaches a preset value.

In the rotational water supply S22, the drum 32 is rotated at the laundry adherence speed RPM1. The controller 51 controls the drum 32 being rotated at the spin-dry rinse speed RPM3 in the spin-dry rinse S21, such that the drum 32 is decelerated to the laundry adherence speed RPM1 and rotated while maintaining the laundry adherence speed PRM1 for a predetermined time period. As described above, the laundry adherence speed RPM1 is set within a range where laundry is able to rotate along with the drum 32 without falling from the highest point inside the drum 32, and the laundry adherence speed RPM1 is a value lower than the spin-dry rinse speed RPM3.

While the drum 32 is rotated at the spin-dry rinse speed RPM3, laundry is already adhered to the drum 32. Thus, even when the rotational speed of the drum 32 is decelerated to the laundry adherence speed RPM1 in the rotational water supply S22, the laundry does not fall from the drum 32.

In addition, even in the case where water is sprayed through the circulation nozzles 610 while the drum 32 is rotated at the laundry adherence speed RPM1, the laundry does not fall from the highest point in the drum although the laundry adherence speed RPM1 is lower than the spin-dry rinse speed RPM3, because the laundry is brought further tightly into contact with the drum 32 by pressure of the sprayed water on the laundry.

During the rotational water supply S22, a water level of the tum 31 is reduced in accordance with the amount of water sprayed through the circulation nozzles 610. Accordingly, additional water supply to the tub 31 is allowed during the rotational water supply S22, and this water supply is implemented preferably through the direct water nozzle 42. The controller 51 rotates the pump motor 92 in the backward direction and opens the nozzle water supply valve 55, thereby spraying water through the circulation nozzles 610 and through the direct water nozzle 42 at the same time. In this case, if a circulation pump is provided in addition to a drain pump, the circulation pump is operated.

The plurality of circulation nozzles 610 are connected to the pump 90 through a common conduit 70 to spray water at the same time upon operation of the pump 90. Preferably, four or more circulation nozzles 610 are configured to spray water in different directions. In addition to multi-directional water spray through the circulation nozzles 610, water spray through the direct water nozzle 42 is performed, thereby enabling more three-dimensional water spray, rinsing laundry in the drum 32 thoroughly, and improving rinse performance.

In particular, in the case where the pump 90 is accelerated to increase a circulation flow rate, more water is absorbed into laundry and a water level of the tum 31 is lowered temporarily. Even in this case, water may be supplied through the direct water nozzle 42, and idling operation of the pump 90 may be prevented.

In addition, in the initial stage of the rotational water supply S22, the amount of water in the tub 31 is still insufficient. Thus, the pump 90 may be rotated at a low speed in the beginning, and the rotational speed of the pump may be gradually increased in progress of the water supply.

Furthermore, after a sufficient amount of water is supplied, the rotational speed of the pump 90 may be "dry spin controlled in a preset pattern. For example, the controller 51 may repeatedly perform an operation of increasing (or decreasing) the rotational speed of the pump motor 92 and then decreasing (or increasing) the same. Since spraying pressure of the circulation nozzles 610 varies by the rotational speed of the pump 90, it is possible to uniformly wet not just a laundry item at the front of the drum 32 but also to a laundry item at the rear of the drum 32.

In particular, if the rotational speed of the pump 90 increase, the spray pressure of the circulation nozzles 610 may increase to make water reach deep inside the drum 32. Thus, if the rotational speed of the pump 90 increases, an area where water currents sprayed from the circulation nozzles 610 reach moves from the front side to the rear side of the drum 32, and there is an effect of sweeping foam or dirt from the laundry in a predetermined direction.

The hygiene cleaning S23 and S24 is implemented when draining the tub 31 and spraying water through the circulation nozzles 610 are stopped. The drainage stopped in the rotational water supply S22 may remain stopped even in the hygiene cleaning S23 and S24. The hygiene cleaning S23 and S24 includes a step of rotating the drum 32 at a first tub cleaning speed while at least a portion of the drum 32 is submerged in water contained in the tub 31.

The first tub cleaning speed is higher than the laundry adherence speed RPM1. During rotation of the drum 32, water contained in the tub 31 may give impact to laundry in the drum 31 to cause the laundry to come off the drum 32 and furthermore cause movement of the laundry. Nonetheless, since the drum 32 is rotated at the first tub cleaning speed higher than the laundry adherence speed RPM1, the laundry may remain adhered to the drum despite the impact by water currents on the laundry. In the present embodiment, the first tub cleaning speed is equal to the spin-dry rinse speed RPM3, but aspects of the present invention are not necessarily limited thereto. That is, it is preferable that the first tub cleaning speed is set within a range where laundry is able to rotate along with the drum 32 while adhered to the drum 32 even when the drum 32 is being rotated in a submerged state in water.

In the course where the drum 32 is rotated at the first tub cleaning speed RPM3, a water current may be formed in the tub 31 by friction with the drum 32. In addition, a water current allowing laundry to rotate along with the drum 32 may be formed by a lifting operation triggered by the lifters 32*a* in the drum 32 or by the laundry adhered to the drum 32. The tub 31 or the drum 32 may be washed by these water currents.

In addition, as in the present embodiment, the drum 32 with a high front surface is rotated about an inclined rotation axis, the tub 31 may be inclined as well to correspond to the drum 32. In this case, a centrifugal force of a water current caused by the rotation of the drum 32 may press water contained between the tub 31 and the drum 32 toward an interior surface of the tub 31. The pressed water current rises along the inclination of the tub 31, reaches the front surface of the tub 31, and is then poured into the drum 32 again. In this course, the effect of washing the front of the tub 31 or the drum 32 may be achieved.

Next, a step S24 of decelerating the drum 32 from the first tub cleaning speed RPM3 to a second tub cleaning speed RPM2 is performed. At the second tub cleaning speed RPM2, laundry remains adhered to the drum 32. Thus, the second tub cleaning speed RPM2 is higher than the laundry adherence speed RPM1. Since the second tub cleaning speed RPM2 is lower than the first tub washing speed RPM3, a water current is not allowed to move forward compared to at the first tub cleaning speed RPM3. As a result, the rear of the tub 31 or the drum 32 is washed primarily.

Next, a step S25 of spraying water into the drum 32 through the direct water nozzle 42 while draining from the tub 31 is performed. In this case, the drum 32 is rotated at a laundry adherence maintaining speed RPM4. The laundry adherence maintaining speed RPM4 is a speed where laundry positioned on an inner surface of the drum 32 does not fall even from the highest point in the drum 32. That is, the laundry adherence maintaining speed RPM4 is a rotational speed of the drum 32 when the centrifugal force and the gravity are equal to each other in the case where a distance from the center of the drum 32 to the laundry is r, and the laundry adherence maintaining speed RPM4 is lower than the laundry adherence speed RPM1. In the present embodiment, the laundry adherence maintaining speed RPM4 is 80 RPM, but aspects of the present invention are not limited thereto. The laundry adherence maintaining speed RPM4 may vary depending on design of the drum 32.

The controller 51 reduces the rotational speed of the drum 32 from the second tub cleaning speed RPM2 to the laundry adherence maintaining speed RPM4, and control the drum 32 to be rotated with maintaining the laundry adherence maintaining speed RPM4 for a predetermined time. Water is drained while the drum 32 is rotated at the laundry adherence maintaining speed RPM4. Accordingly, since the water level of the tub 31 is lowered quickly, a small amount of impact is applied by water in the tub 31 on the laundry, and thus, the laundry it not separated from the drum 32. Foam or dirt separated from the laundry in the tub cleaning process are drained.

While the drum 32 is rotated at the laundry adherence maintaining speed RPM4, the controller 51 may open the nozzle water supply valve 55 to spray water through the direct water nozzle 42. The laundry is rinsed for the last time, and then the spin dry cycle S3 is implemented.

The method of controlling a washing machine of the present invention performs tub cleaning for hygiene purposes in a series of procedures performed to rinse laundry. Accordingly, water used in a rinse cycle may be used for tub cleaning, thereby reducing a total amount of water consumption. In addition, as foam and contaminants adhered to a tub or a drum are removed by the tub cleaning, it is possible to prevent secondary contamination of the laundry in the rinse cycle.

Second, after spin-dry rinse is performed to remove detergent adhered to laundry, a water level is increased by supplying water to the tub and the laundry is rinsed using circulation nozzles. Accordingly, an amount of water consumption may be reduced and rinse performance may improve.

Third, while the drum is rotated with laundry adhered thereto, spin-dry rinse, water supply rinse, and hygiene cleaning are performed. Accordingly, the laundry may be rinsed uniformly and a capability of the laundry adhered to the drum to lift water may improve.

Fourth, as the tub cleaning can be performed with water used in rising the laundry, it is possible to keep the inside of the tub clean even without an additional tub cleaning course.

Fifth, a sufficient amount of water remains even when circulating water is sprayed with high pressure by increasing a pump rate. Accordingly, it is possible to rinse the laundry powerfully and quickly.

Sixth, it is possible to reduce foaming in the rinse cycle.

Seventh, as water is sprayed through a direct water nozzle and circulation nozzles at the same time, three-dimensional spraying of water may be enabled, thereby uniformly wetting the laundry.

As described above, the method of controlling a washing machine described in this disclosure is an illustrative purpose only, and the present invention is not limited thereto. Thus, it should be understood that numerous other modifications and embodiments can be devised by those skilled in the art within the spirit and scope of the present invention and they will fall within the scope of the present invention.

What is claimed is:

1. A method of controlling a washing machine including a tub configured to receive water, a drum rotatably disposed in the tub and configured to receive laundry through an introduction hole defined at a front of the drum, the method comprising:

rotating the drum at a spin-dry rinse speed to allow the laundry in the drum to rotate along with the drum and to be raised along an inner surface of the drum without falling from a highest point of the inner surface of the drum;

draining water from the tub while rotating the drum at the spin-dry rinse speed;

supplying water to the tub to increase a water level in the tub;

rotating the drum at a laundry adherence speed lower than the spin-dry rinse speed, the laundry adherence speed being set within a range of a rotation speed of the drum that allows the laundry to rotate along with the drum without falling from the highest point of the inner surface of the drum;

stopping draining water from the tub such that at least a portion of the drum is disposed below the water level in the tub;

in a state in which draining of the water from the tub is stopped and without supplying water to the tub after rotating the drum at the laundry adherence speed, accelerating the drum from the laundry adherence speed to a first tub cleaning speed;

in the state in which draining of the water from the tub is stopped and without supplying water to the tub, rotating the drum at a second tub cleaning speed that is less than the first tub cleaning speed; and after rotating the drum at the second tub cleaning speed, rotating the drum at a laundry adherence maintaining speed less than the second tub cleaning speed while draining the water from the tub and supplying water to the tub, the laundry adherence maintaining speed being a preset rotation speed of the drum at which the laundry positioned on the inner surface of the drum does not fall from the highest point of the inner surface of the drum.

2. The method of claim 1, wherein rotating the drum at the spin-dry rinse speed comprises accelerating the drum from a stopped state to the spin-dry rinse speed.

3. The method of claim 1, wherein rotating the drum at the laundry adherence speed comprises decelerating the drum from the spin-dry rinse speed to the laundry adherence speed.

4. The method of claim 1, wherein supplying water to the tub comprises supplying water to the tub through a dispenser configured to receive detergent and water.

5. The method of claim 1, wherein supplying water to the tub comprises suppling water to the tub based on stopping draining water from the tub.

6. The method of claim 1, further comprising:

performing a washing operation, the washing operation comprising supplying detergent to the drum, and rotating the drum to wash the laundry in the drum with detergent-dissolved water, wherein the washing operation is performed before rotating the drum at the spin-dry rinse speed.

7. The method of claim 6, further comprising:

performing a spin drying operation based on completion of a rinsing operation, wherein the spin drying operation comprises rotating the drum at a first spin dry speed lower than the spin-dry rinse speed and at a second spin dry speed higher than the spin-dry rinse speed.

8. The method of claim 7, wherein the first spin dry speed is lower than the laundry adherence speed.

9. The method of claim 1, further comprising:

spraying water into the drum through a direct water nozzle; and, circulating water in the tub to spray circulated water into the drum through a plurality of circulation nozzles, wherein rotating the drum at the spin-dry rinse speed is performed while water is sprayed into the drum through the direct water nozzle, and wherein rotating the drum at the laundry adherence speed is performed while the circulated water is sprayed through the plurality of circulation nozzles.

10. The method of claim 9, wherein spraying water through the direct water nozzle is performed while the circulated water is sprayed through the plurality of circulation nozzles.

11. The method of claim 9, wherein the plurality of circulation nozzles are connected to a pump through a conduit, and wherein circulating water in the tub comprises simultaneously spraying the circulated water based on operation of the pump.

12. The method of claim 11, wherein the plurality of circulation nozzles include four or more circulation nozzles, and wherein simultaneously spraying the circulated water is performed through the plurality of circulation nozzles in a plurality of directions.

13. The method of claim 9, wherein circulating water in the tub comprises:

while spraying the circulated water through the plurality of circulation nozzles, varying a speed of a pump configured to circulate water in the tub to the plurality of circulation nozzles.

14. The method of claim 9, further comprising:

decelerating the drum from the first tub cleaning speed to a second tub cleaning speed higher than the laundry adherence speed.

15. The method of claim 14, further comprising:

spraying water into the drum through the direct water nozzle while draining the tub; and decelerating the drum from the second tub cleaning speed to a laundry adherence maintaining speed.

16. The method of claim 9, wherein the washing machine further includes a pump configured to rotate in a forward direction and a backward direction, wherein draining water from the tub comprises rotating the pump in the forward direction, and wherein spaying the circulated water comprises rotating the pump in the backward direction.

17. The method of claim 16, wherein the washing machine further includes a main water supply valve configured to supply water to at least one of the direct water nozzle or a detergent dispenser, and a nozzle water supply valve configured to supply the circulated water to the plurality of circulation nozzles, the method further comprising:

closing the nozzle water supply valve; and in response to closing the nozzle water supply valve, decelerating the drum from the spin-dry rinse speed to the laundry adherence speed.

18. The method of claim 17, further comprising:

stopping rotation of the pump in the forward direction; and in response to stopping rotation of the pump in the forward direction, opening the main water supply valve to supply water to the tub through at least one of the direct water nozzle or the detergent dispenser.

19. The method of claim 18, wherein stopping rotation of the pump in the forward direction is performed based on an elapse of time after closing the nozzle water supply valve.

20. The method of claim 18, wherein decelerating the drum from the spin-dry rinse speed to the laundry adherence speed is performed while maintaining rotation of the pump in the forward direction.

21. The method of claim 1, wherein the drum is configured to rotate about a rotational axis that is inclined upward at a predetermined angle relative to a horizontal axis.

22. The method of claim 9, wherein the plurality of circulation nozzles are disposed symmetrically at a left side and at a right side with respect to a center of the introduction hole of the drum, and wherein plurality of circulation nozzles comprise:

a first circulation nozzle disposed at one side among the left side and the right side and configured to spray water downward; and a second circulation nozzle disposed at the same side as the first circulation nozzle and positioned below the first circulation nozzle, the second circulation nozzle being configured to spray water upward.

* * * * *